US005926084A

United States Patent [19]

Fröchte

[11] Patent Number: 5,926,084

[45] Date of Patent: Jul. 20, 1999

[54] ELECTRIC FUSE AND METHOD OF MAKING THE SAME

[75] Inventor: Bernd Fröchte, Recklinghausen, Germany

[73] Assignee: Wickmann-Werke GmbH, Germany

[21] Appl. No.: 08/784,921

[22] Filed: Jan. 16, 1997

[30] Foreign Application Priority Data

Jan. 18, 1996 [DE] Germany ..... 196 01 612

[51] Int. Cl.[6] ..... H01H 85/143

[52] U.S. Cl. ..... 337/231; 337/227; 337/252; 29/623

[58] Field of Search ..... 337/168, 231, 337/232, 251, 248, 227, 252; 29/623; 439/621, 622

[56] References Cited

U.S. PATENT DOCUMENTS 4,612,529 9/1986 Gurevich et al. .
4,924,203 5/1990 Gurevich .
5,363,082 11/1994 Gurevich .

FOREIGN PATENT DOCUMENTS 0 133 136 2/1985 European Pat. Off. .
10 19 242 11/1957 Germany .
94 10 437 U 8/1994 Germany .
94 07 550 U 9/1994 Germany .
2-288038 11/1990 Japan .

*Primary Examiner*—Leo P. Picard
*Assistant Examiner*—Jayprakash N. Gandhi
*Attorney, Agent, or Firm*—Banner & Witcoff, ltd.

[57] ABSTRACT

A fuse includes at least one ceramic part at least partially surrounded by a sinterable mass coating that is electrically conductive after a sintering process. The sinterable mass coating is disposed in the vicinity of the two remote sides of the first part. The fuse also includes a second part firmly connected to the first part by the mass coating. The second part has an electrically conductive surface and a fuse element. A method for manufacturing a blowout fuse includes fixing a first part of the fuse made from metal or a ceramic material to a second part of the fuse made from metal or a ceramic material using a sinterable mass. This method includes the steps of applying a mass to be fixed by sintering to at least one portion of the surface of the first part and/or one portion of the surface of the second part. The mass acts as an intermediate layer between the two parts to be connected and wholly or partially covers both surfaces. In a heat treatment suitable for sintering, the mass is firmly connected to the portions of the surfaces of the parts to which they are applied.

17 Claims, 2 Drawing Sheets

ELECTRIC FUSE AND METHOD OF MAKING THE SAME

BACKGROUND OF THE INVENTION

The invention relates to electric fuses and a method for fixing a first part of a fuse made from metal or a ceramic material to a second part of the fuse made from metal or a ceramic material in the manufacture of electric fuses, more particularly, the present invention relates to appliance fuses and a connection formed of sintered material positioned between two parts made from different materials for producing a blowout fuse.

In the sense of the invention, the term "ceramic material" covers all ceramics, as well as metal and glass ceramics and also glasses.

The method extends the group of connecting and fixing processes known in the field of electric fuse manufacturing. Hitherto, nonmetallic parts such as glasses could be bonded together or joined in a partly melted state. Ceramic materials and glass ceramics could be assembled in a moist state and then jointly baked. In addition, solder glass could be used for joining together parts having rough surfaces.

Numerous methods are known in the manufacture of electric fuses for fixing two metallic parts. They differ through the temperature range at which the fixing process takes place. Thus, processes such as adhering, bonding, clamping, etc. are carried out at normal ambient temperatures, whereas when welding together two materials, very high temperatures are necessary. The two metallic parts can also be jointed by an additional material, such as e.g., in adhesion, a conductive adhesive at normal temperatures or a solder at greatly increased temperatures.

Most of the aforementioned methods cannot be used when joining metals to non-metals and specifically when fixing a metallic or metal-containing material to a ceramic material.

Fastenings of this type, inter alia, play a major part in the manufacture of electric fuses using so-called thick film technology. In thick film technology, complete circuits are produced on a ceramic substrate. For this purpose, electric contacts, conductors and resistance layers are applied to a ceramic substrate. Also, prefabricated components or subassemblies are integrated into the circuit as SMD elements. For this purpose, the necessary contact points, conductors and resistors are applied to the ceramic surface as pulverulent layers of metal-containing mixtures. This can also take place in the form of pastes, which carry the same material mixture as an emulsion. The permanent fixing of the very fine-grained materials takes place by firing. Firing is a process in which all the components of the applied fine-grained mass are interconnected. As a function of the composition of the mixtures, this takes place at or above 800° C. The procedure involving the application of pastes and firing can be repeated. In successive stages it is possible to form complex structures on the substrate. Only subsequently in a further manufacturing step are components soldered to the contacts, which cannot be exposed to the elevated temperatures of the firing process, such as e.g. transistors.

In the manufacture of electric fuses in thick film technology, the metal mixtures are applied in the same way to the ends or terminal edges of ceramic substrates. As with fuses, the fuse element can be subsequently applied to the ceramic support in the form of a further layer between the contacts. Particularly in the overload range of the fuse, this structure leads to an intense heat dissipation from the fuse element of the fuse to the support material. This heat dissipation is detrimental to the function of the component as a fuse.

From the thermal insulation standpoint, a fuse element in air or inert gas is more favorable for the structure of a fuse. In this case, for example, a first fuse ceramic substrate in the form of a support and a second ceramic substrate serving as a cover are metallized by firing a paste. This produces electric contacts at remote ends of the substrates. A wire is fixed between the two contacts for acting as the fuse element. This arrangement is permanently interconnected by adhesion. A reliable electrical connection of the contacts to one another and to the fuse element takes place in a subsequent working stage by soldering.

Thus, hitherto, for the manufacture of blowout fuses it has always been necessary to have a multistage operating procedure. Examples for possible manufacturing methods are given in German utility model 94 07 550.6. One of these methods is based on half-shells, whose ends are metallized and between which the fuse element is fixed to both halves by adhesion. The fuse is assembled by adhesion or clamping. In a subsequent stage, soldering produces a reliable electrical contact between the metallizations serving as contact points and the fuse element. Thus, this production method for the mechanical fixing and electrical connection involves several working stages, such as the metallization of the ends of the half-shells and the soldering, both being heat processes involving relatively high temperatures. Adhesion and bonding constitutes auxiliary processes requiring additional materials that are not necessary for the function of the fuse.

All the other hitherto known methods for the manufacture of electric fuses, particularly appliance fuses made from one or two ceramic or glass bodies or using metal caps at the ends require numerous individual, successively performed stages for fixing the components.

Therefore the problem arises of providing a method usable in the manufacture of electric fuses for the reliable mechanical fixing of a first part made from metal or a ceramic material to a second part made from metal or a ceramic material.

BRIEF SUMMARY OF THE INVENTION

The fuse and method of manufacturing the fuse according to the present invention solve the above discussed problems. The fuse includes at least one ceramic first part and a second part having an electrically conductive surface. A mass to be fixed by sintering is applied to at least one part of the surface of the first part and/or one part of the surface of the second part for joining them together. The two parts are so contacted that the sinterable mass acts as an intermediate layer and wholly or partly covers both surfaces. In a heat treatment suitable for sintering, the mass is firmly connected to the portions of the surfaces of the parts that it covers.

The fixing method for the manufacture of electric fuses proposed according to the invention involves a sintering stage. The term "sintering" describes a heat treatment, in which a pulverulent material mixture is not completely melted and instead junctions or connections are only formed at the grain or particle boundaries of the material mixture by diffusion and alloying. The resulting connections are mechanically reliable and durable and can also be used for fixing one part to a second part. As a function of the composition of the mixture, it can also be thermally loaded, namely to a higher extent than the numerous adhesives conventionally used for producing such connections. In an extension, more than two parts can be interconnected in a sintering process.

A further development of the method particularly advantageous for the manufacture of electric fuses is that the mass used for joining the individual parts has, after sintering, electrically conductive properties. Thus, simultaneously with the mechanical connection, an electrical contact can be produced. For the case that one of the parts to be connected is itself electrically conductive, the part is not only mechanically fixed, but, as a result of the method, simultaneously provided with a contact layer. For this to occur, the part must be electrically conductive, at least on its surface.

Particular interest is attached to the processing of parts with a ceramic surface using this method. The parts used can be both tubular and also randomly flat. In the field of electric appliance fuses, ceramic materials, e.g. in the form of small tubes and flat ceramic boards having planar surfaces and a central trough-shaped depression in the largest of their rectangular surface pieces, are preferably used.

All the subsequently described methods for the manufacture of fuses involve a sintering mass, particularly for the manufacture of electric contacts, being applied to remote sides of a substrate. The mass advantageously passes round the sides in such a way that it is in contact with a narrow strip of the adjacent surface or surfaces. After the sinterable mass has been applied to two points, the fuse element is inserted between these points so that it is in the correct position and is also in contact with the sinterable mass. The subsequent sintering process joins the substrate to the sinterable mass and also produces outwardly conducting contacts for the substrate. Simultaneously, the fuse element is joined in a mechanically strong and electrically conductive manner to the sinterable mass, so that it can now be electrically loaded via the two outer contacts. Thus, the fuse is fundamentally and completely manufactured in a single method stage. For the protection of the fuse element, in the case of a simple fuse design, the fuse element can be covered over its entire length on the ceramic substrate between the two contact points by an electrically insulating encapsulating material.

Instead of applying an insulating encapsulating material after the sintering process, the electrical conductor can be covered by a further ceramic part prior to the sintering process. It is merely necessary for the ceramic part to extend over the fuse element from one mass contact to the other and be in contact therewith at their surfaces. Thus, in one sintering process, namely by a single method stage, the substrate, fuse element and covering ceramic can simultaneously be mechanically and electrically interconnected. This interconnection provides a strong mechanical bond that is electrically conductive.

In a particular advantageous embodiment, between the points covered with the sinterable mass, the ceramic substrate has a trough-shaped depression. Between the points which subsequently come into contact with the sinterable mass, the covering ceramic also has a trough-shaped depression. Thus, at the time of assembly, the fuse element is already carried by the substrate via the two mass layers and is only in contact with the ceramic cover at the points covered by the sinterable mass. Thus, at the end of the sintering process, the fuse element is mechanically connected to the substrate and to the cover by way of the two newly formed electric contact points. Consequently, the fuse element is held in a self-supporting manner. Thus, between its connection points, the fuse element is only surrounded by a gas layer with high thermal insulation and can, consequently, acquire the desired switching characteristics.

In another embodiment, the ceramic support is in the form of a tube, which is covered on its faces with the sinterable mass. The fuse element is introduced through an opening and passes within the tube from one face to the other in a self-supporting manner and is only surrounded by gas. Here again, the sintering process fulfils the functions of mechanical fixing and electrical connecting of the fuse element.

The tube openings of this embodiment can be closed on either side by electrically conductive caps prior to the sintering process. The conductive caps can be connected to the tube and to the fuse element in the same sintering stage in a mechanically firm and electrically conductive manner. Similar measures are conceivable in other embodiments.

The combination of materials in the sintering mass is important in the method with respect to the parts to be joined. The mass must have metallic constituents in order to achieve the conductive and mechanical connection to the fuse element. The constituents must also permit a reliable fixing of the mass to the surface of the ceramic of the remaining parts during the sintering process. Thus, the mass can belong to the family of cermets, i.e. so-called metal ceramics. However, in this method and unlike in typical cermet processes, the powder is used directly or advantageously in the form of a paste and is not moulded under high pressure to form a moulded blank. A possible combination is constituted by the fixing of a silver wire to a ceramic substrate using a sintering mass of silver, platinum and palladium.

BRIEF DESCRIPTION OF THE DRAWINGS

The method according to the invention is described in greater detail hereinafter relative to embodiments and the attached drawings, wherein.

DETAILED DESCRIPTION OF THE INVENTION

Figure 1:
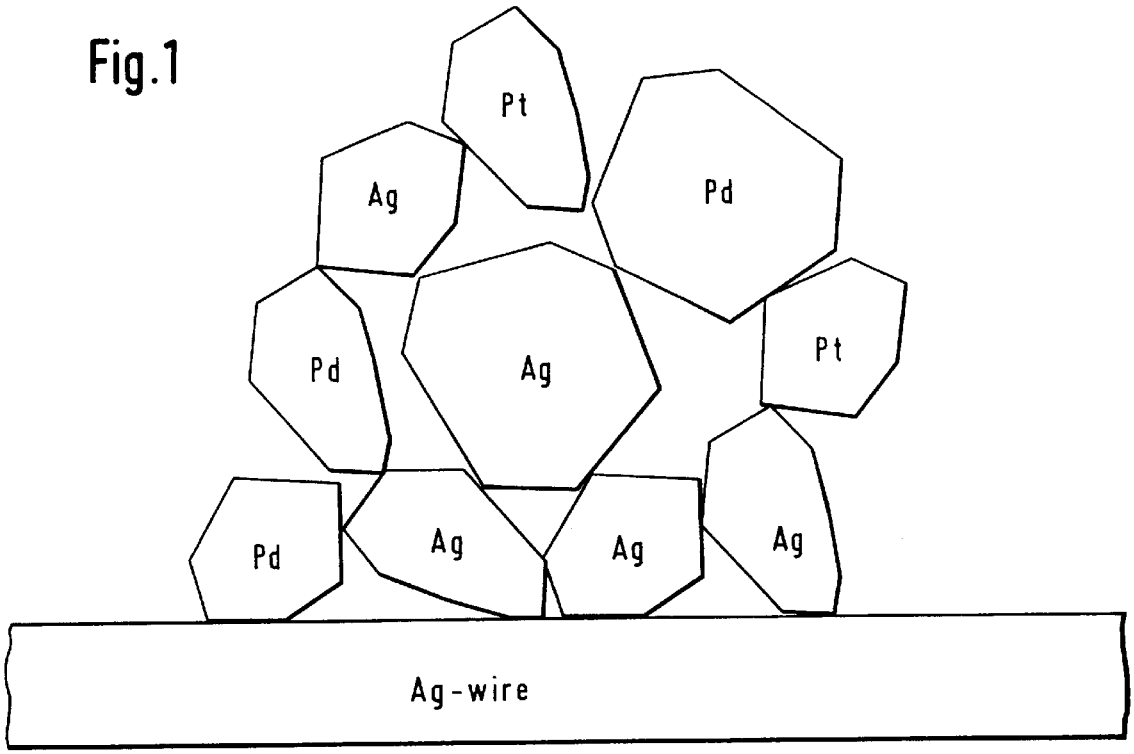
FIG. 1 is a basic diagram for the sintering process on a silver wire with an Ag—Pd—Pt sintering mass.

FIG. 1 shows the attachment of the granules of a sintering mass of silver-palladium-platinum to a silver wire. The edges and faces of the individual granules abut against one another. In part they are in contact with the surface of the silver wire. As a result of the sintering process there is no complete melting of the participating pulverulent materials and instead there is merely a material transfer between the granules, so that they are interconnected at the contact points. Diffusion processes take place. Thus, the granules do not lose their shape. This leads to a firm, porous mass, which as a result of its constituents, has good conductivity. Thus, a mechanically stable and electrically conductive contact is applied and connected to the surface of the silver wire.

Figure 2:
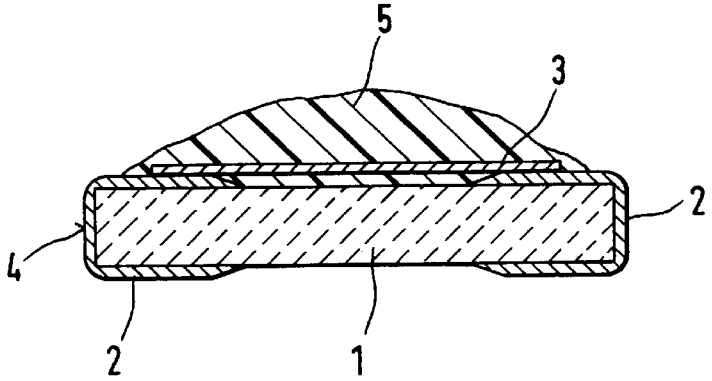
FIG. 2 is a sectional view of a one-part casing with encapsulated fuse element.

FIG. 2 shows a cross-section of an electric fuse. A sinterable mass 2 is applied to both sides of a ceramic substrate 1. A fuse element 3 is applied to the upper surface of the ceramic between the sinterable mass-covered ends of the substrate 1. In a single sintering stage, in the manner described hereinbefore, simultaneously contacting and fixing occur. Subsequently, the fuse element 3 is covered between the contact points by an encapsulating material 5. Thus, this manufacturing method for the fuse advantageously only involves four stages, namely application of the sintering mass, insertion of the fuse element, sintering and encapsulating. The working stages of metallization, fixing and soldering are avoided.

Figure 3:
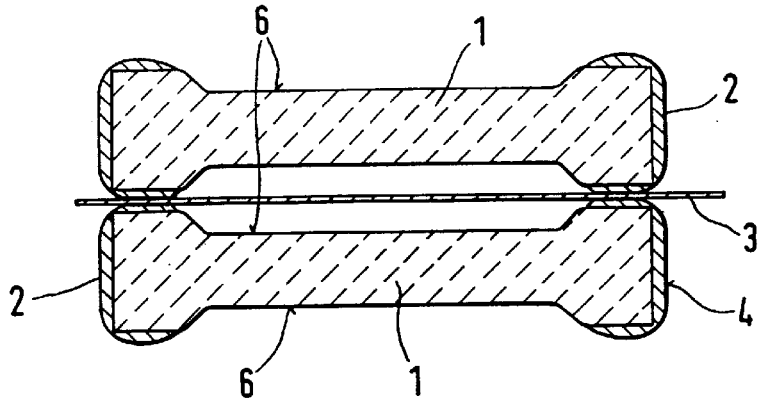
FIG. 3 is a sectional view of a two-part, ceramic fuse with a self-supporting fuse element passing through air.

FIG. 3 shows a particular favorable design of a SMD fuse with a fuse element 3 in a chamber. For reducing the different constituents of the fuse, the ceramic substrate 1 and the cover 1 are formed by identically shaped, symmetrical ceramic parts. With respect to the ceramic parts, during production it is merely necessary to distinguish between their narrow side and their wide side for positioning the fuse element 3 over a trough 6. In a fully automatic manufacturing process, no further parameters have to be taken into account. As shown in FIG. 3, both parts are coated on both sides with sinterable mass 2 and subsequently, undergo a sintering process. Fuse element 3 is held between the parts in the mass layer during the sintering process. Advantageously, with this fuse, there is no need for a subsequent treatment in a final stage. Thus, this method only consists of three stages. The fuse is closed and the fuse element 3 is now electrically accessible by way of the sintered, electrically conductive contact points 4.

As a further advantage, this fuse does not have any firmly defined upper or lower part. Thus, in a simple manner, it can be integrated by automatic insertion machines into thick film circuits or can be soldered as a SMD component into printed circuits. This leads to a considerable reduction of the costs of production and the costs of using the fuse.

Figure 4:
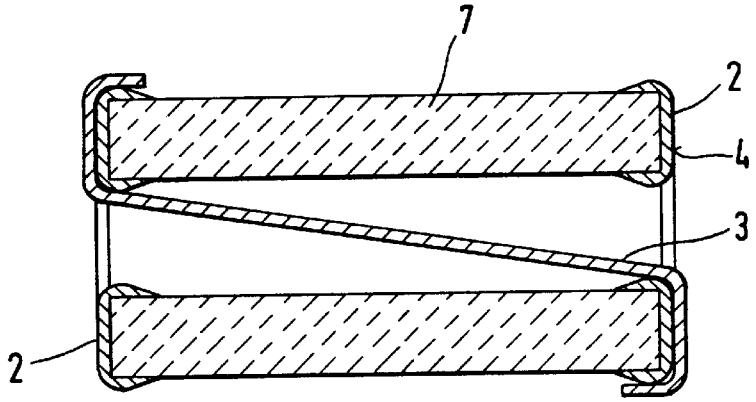
FIG. 4 is a cross-section through a tubular casing with a fuse element electrically connected and fixed by sintering.

FIG. 4 shows a basic tubular fuse with a ceramic, tubular support 7, whose faces are covered with sinterable mass 2. The fuse element 3 passes from one face to the other within the tube. At each face, the fuse element 3 is in contact with the sinterable mass 2. Thus, in one sintering stage, it is connected both electrically and mechanically to the contact points 4, while the mass 2 is firmly connected to the surface of the ceramic support 7.

Figure 5:
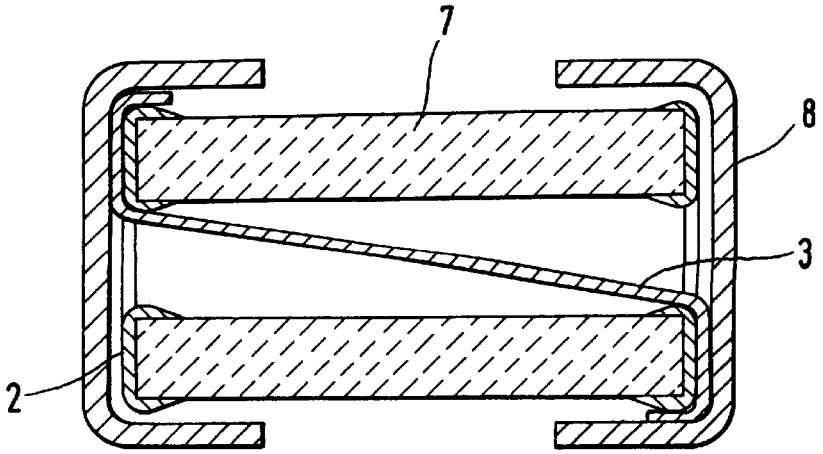
FIG. 5 is a cross-section through the tubular fuse of FIG. 4 with frontally fitted metal caps fixed and conductively connected by the sintering process.

FIG. 5 shows an addition to the tubular fuse of FIG. 4. In this case, the faces of the tube 7 are closed by metal caps 8 prior to the sintering process. Only for reasons of clarity of representation, the metal caps 8 are shown in exaggerated form in FIG. 5. In a single sintering stage all the parts of the fitted fuse are reliably, mechanically and electrically interconnected.

I claim:

1. A blowout fuse comprising:

at least one ceramic first part at least partly surrounded by a sinterable mass coating, said mass coating being electrically conductive after a sintering process and being disposed in the vicinty of two remote sides of said first part;

a second part having an electrically conductive surface, said mass coating being in contact at said sides with said second part;

wherein said mass and said fast and second parts are firmly interconnected;

wherein said second part includes a fuse element of said fuse.

2. The blowout fuse according to claim 1, wherein said ceramic first part is flat and includes a trough in a central area of at least one surface thereof and said fuse element is covered at least in an area between said mass-covered two remote sides.

3. The blowout fuse according to claim 1, wherein said fuse element is covered by an electrically insulating encapsulating material.

4. The blowout fuse according to claim 1, wherein said at least one ceramic first part includes a first ceramic part and a second ceramic part, said fuse element being held between said mass coatings at the end of the sintering process and by electrically conductively connected by said first and second ceramic parts that are surrounded in the vicinity of said two remote sides in an at least partial manner by said mass.

5. The blowout fuse according to claim 4, wherein said ceramic first part and said ceramic second part are flat and in each instance include a trough in a central area of at least one surface, said troughs of said first and second ceramic parts facing one another such that said fuse element is held in a self-supporting manner between said mass coatings.

6. The blowout fuse according to claim 1, wherein said ceramic first part includes a tube having a first face and a second face, said fuse element passing through openings of said tube from said first face to said second face, said openings being provided with said sinterable and then electrically conductive mass such that, at the end of the sintering process, said fuse element is held and electrically conductively connected to said faces.

7. The blowout fuse according to claim 6, wherein said tube includes an electrically conductive end cap disposed on each side thereof, said end cap being fixed by sintering.

8. Method for manufacturing an electrical blowout fuse including fixing a surface of a first ceramic part to an electrically conductive surface of a second part comprising a fuse element, said method comprising:

applying a sinterable mass coating that is to be fixed by sintering to at least a portion of the surface of at least one of said first part and said second part, said portion of said surface of said at least one of said first part and second part to be joined together with a portion of the surface of the other of said first part and said second part;

sintering the mass coating in a heat treatment process such that said mass coating is firmly connected to said portions of said surfaces of said first and second parts, thereby connecting said first part and said second part so that said mass coating forms at least an intermediate layer at least partly covering said surface of said first part and said surface of said second part;

wherein said mass coating is electrically conductive after said heat treatment in said sintering step; and wherein said first ceramic part is further at least partly surrounded by said mass coating in the vicinity of two remote sides, the mass coating being in contact with both said sides of said first part and said second part so as to define two contact points.

9. The method according to claim 8, wherein said first part is a flat ceramic material.

10. The method according to claim 9, wherein said flat ceramic material includes a trough in at least one surface thereof.

11. The method according to claim 10, wherein said flat ceramic material is covered at least in the vicinity of said fuse element.

12. The method according to claim 11, wherein said fuse element is covered by an electrically insulating encapsulating material.

13. The method according to claim 12, wherein said flat ceramic part and said fuse element are covered between said mass-covered contact points by a further mass-coverable component made from a ceramic in such a way that said mass in the vicinity of said two remote sides of said first part comes into contact with corresponding surfaces of said further mass-coverable component.

14. The method according to claim 13, wherein said at least one of said first part and second part comprises said first part and said further mass-coverable component comprises a third part, said third part being identical to said first part such that, after said sintering step, said fuse element extends between said first and third parts and is held in a self-supporting manner by said mass coating and said fuse element is electrically conductively connected on each side to the intermediate layer of mass.

15. The method according to claim 14, further comprising placing an electrically conductive end cap over each said remote side of said parts and fixing said end caps relative thereto by sintering.

16. The method according to claim 8, wherein said first part is a tubular ceramic material.

17. The method according to claim 8, wherein said first ceramic part includes a first face of a tube and said second part includes a second face of said tube; said method further comprising the steps of applying said mass coating to said first and second faces and extending the fuse element from said first face of said tube to said second face of said tube.

* * * * *